US007804037B2

(12) United States Patent
Cove

(10) Patent No.: US 7,804,037 B2
(45) Date of Patent: Sep. 28, 2010

(54) PUSH BUTTON ASSEMBLY

(75) Inventor: James Cove, Blakes Hall (GB)

(73) Assignee: Gamesman Limited, Crompton Fields, Compton Way, Crawley, West Sussex (GB)

( * ) Notice: Subject to any disclaimer, the term of this patent is extended or adjusted under 35 U.S.C. 154(b) by 717 days.

(21) Appl. No.: 10/590,561

(22) PCT Filed: Oct. 17, 2005

(86) PCT No.: PCT/GB2005/003970

§ 371 (c)(1),
(2), (4) Date: May 14, 2007

(87) PCT Pub. No.: WO2006/040577

PCT Pub. Date: Apr. 20, 2006

(65) Prior Publication Data

US 2008/0073190 A1 Mar. 27, 2008

(30) Foreign Application Priority Data

Oct. 15, 2004 (GB) ..... 0422927.4
Oct. 15, 2004 (GB) ..... 0422939.9

(51) Int. Cl.
*H01H 13/00* (2006.01)
*H01H 9/18* (2006.01)

(52) U.S. Cl. ..... 200/520; 200/314; 200/341; 200/573

(58) Field of Classification Search ..... 200/520, 200/310, 314, 573, 574, 296, 317, 313, 341, 200/344, 345
See application file for complete search history.

(56) References Cited

U.S. PATENT DOCUMENTS 4,301,344 A * 11/1981 Sakakino et al. ..... 200/314
5,165,530 A * 11/1992 Shinohara et al. ..... 200/314
5,201,408 A 4/1993 Torma et al.
6,102,394 A * 8/2000 Wurz et al. ..... 273/138.2
6,310,308 B1 10/2001 Watson et al.
6,590,176 B2 * 7/2003 Cole et al. ..... 200/341

(Continued)

FOREIGN PATENT DOCUMENTS

EP 0 342 703 A2 11/1989

(Continued)

*Primary Examiner*—Michael A Friedhofer
(74) *Attorney, Agent, or Firm*—John H. Pearson, Jr., Esq.; Walter F. Dawson, Esq.; Pearson & Pearson, LLP.

(57) ABSTRACT

A push button assembly comprises a button (1) with an actuating structure (5) movably mounted within a housing (2) for operation of a switch (20). The housing (2) provides a frame (18) comprising side wall structures (16), with a flange structure (15) mounted at a top open end thereof, The axial length of the housing (2) is shorter than the horizontal length of the side wall structures (16), resulting in a short push button assembly. The button (1) is illuminable via a lamp (25) which is provided on a carrier strip (22), the switch (20) being mounted on a body (19), both of which can be removably mounted substantially within the confines of the housing (2), with respective connection terminals (23, 21) projecting outward thereof, the assembly therefore occupying minimal space behind a panel when mounted on such a panel of an amusement or gaming machine where space may be restricted.

16 Claims, 2 Drawing Sheets

U.S. PATENT DOCUMENTS

| | | | | |
|---|---|---|---|---|
| 6,717,081 | B2 * | 4/2004 | Miyake | 200/296 |
| 6,870,114 | B2 * | 3/2005 | Cole et al. | 200/341 |
| 6,965,085 | B1 * | 11/2005 | Orrico et al. | 200/314 |
| 6,987,233 | B2 * | 1/2006 | Cole et al. | 200/341 |
| 7,002,092 | B2 * | 2/2006 | Ichimaru | 200/523 |
| 7,060,922 | B2 * | 6/2006 | Hoehne et al. | 200/314 |
| 7,442,890 | B1 * | 10/2008 | Chen et al. | 200/314 |
| 7,507,924 | B2 * | 3/2009 | Lorenzo Riera et al. | 200/314 |
| 7,554,047 | B2 * | 6/2009 | Verdu et al. | 200/314 |
| 2002/0144882 | A1 | 10/2002 | Yamaguchi | |

FOREIGN PATENT DOCUMENTS

| | | | |
|---|---|---|---|
| EP | 0 406 845 | A2 | 1/1991 |
| EP | 0 463 285 | A1 | 1/1992 |
| EP | 1 091 374 | A1 | 4/2001 |
| WO | WO 2006/040577 | A1 | 4/2006 |

* cited by examiner

PUSH BUTTON ASSEMBLY

TECHNICAL FIELD

The invention relates to push button assemblies and is particularly though not exclusively concerned with a push button assembly for use within an amusement or gaming machine.

BACKGROUND ART

A push button assembly as used with an amusement or gaming machine typically comprises a push button, a housing, a lamp and switch unit, and an actuating structure with a spring.

GB 2350722 A discloses a push button assembly of this kind. The push button comprises a translucent disc, a transparency and a fitted lens cap. The housing is an open ended tubular structure with a flange around one end defining a bezel. The push button is movably retained within the flange and the lamp and switch unit is attached removably to the opposite open end of the housing so that the lamp is within the housing for illumination of the button and the switch is outside the housing. The actuating structure comprises a hollow stem with at least one hooked finger which is located in the housing between the push button and the switch. The tubular structure of the housing is threaded. In use the tubular structure is passed through an aperture in a panel of the machine with the flange on the outside and a nut is screwed onto the tubular structure against the underside of the panel to hold the housing firmly attached to the panel.

With this known push button assembly the length beneath the panel which includes the lamp and switch unit is relatively large. This can be a problem in machines where there is little space behind the panel.

An object of the present invention is to provide a push button assembly which can be made with reduced length so as to be suitable for use where space for installation is restricted.

DISCLOSURE OF THE INVENTION

According to the invention therefore, there is provided a push button assembly comprising a housing with an open end thereto bounded by a flange structure, the housing being insertable through an aperture in a panel with the flange on an outer side thereof, a fixing means for fixing the housing relative to the panel beneath the panel, a push button movably mounted within the open end and flange structure, a lamp mountable relative to the housing for illuminating the button, a switch mountable relative to the housing for operation by movement of the button via an actuating structure disposed between the button and the switch within the housing, characterised in that the lamp and the switch are mounted within the housing so that at least a major part of the lamp and the switch is located within the confines of the housing.

With this arrangement, the push button assembly beneath the panel can be of reduced length since the lamp and the switch are incorporated in the housing rather than being attached thereto substantially externally of the housing. Less space may therefore be needed for installation beneath the panel.

Preferably the housing has a generally open square frame structure comprising side wall structures with the flange structure mounted at one end. Alternatively the frame structure may be generally rectangular or circular or polygon in shape. The housing may provide abutments for supporting the actuating structure. Preferably one of the side wall structures may be generally open to provide access to the interior of the housing. The frame structure is preferably shorter in axial length than the horizontal length of each of the side wall structures.

Preferably also, the flange has outwardly inclined side walls which taper towards the top free end. The flange is preferably opaque.

The flange structure may comprise a downwardly projecting skirt part defining a peripheral gap between the side wall structures and said skirt part. The skirt part may be light-transmitting. The skirt part may provide an illuminable boundary. The boundary may be illuminable by an illumination means disposed in said gap. The illumination means is preferably in the form of multiple LEDs on a printed circuit board. The housing frame 18 may pass through an aperture in said board. The LEDs are preferably independently operable from said lamp and/or each other.

The independently operable LEDs may be operable together in a static or flashing arrangement to give the effect of a "halo" around the button. Alternatively they may be operable in any sequence to display points of light around the boundary.

This provides an additional illumination arrangement where the boundary may be lit alone or with the lamp to indicate a different button status. Additionally or alternatively the illumination of the boundary may be operable in a non-play mode to attract players.

The housing may provide electrostatic protection to any circuitry within said housing by providing "grounding members" which make contact with the panel which is also conductive and connected to the ground, to discharge any introduced electrical charges. In this respect, a gaming machine housing may have low conductivity properties or there may be a printed "circuit" which leads across the panel to the housing which is grounded itself or which has an earthing/grounding component fixed thereto. This prevents spurious and fraudulent actuation of the button. The grounding members preferably comprise, for example, carbon conductive structures or other suitable conductive structures. In this respect, the flange is also conductive and preferably comprises a carbon conductive material.

The fixing means may comprise one or more clips provided on one or more of the side wall structures, engageable with one or more holes provided in the panel. There may be pairs of spring clips on the outer sides of some or all opposing side wall structures. The or each clip may be engageable with the aperture for the housing or a hole separate thereto.

The push button may comprise the switch actuating structure, mounted upon which are a translucent cover part and a translucent cap. The translucent cap may have an upwardly convex domed top wall with downwardly projecting edge walls. The cover part may have a projection on its lower surface for interaction with the spring members. The cover part and the cap may be the same in shape as the frame structure of the housing. Alternatively, the cover part and the cap are the same in shape as the opening provided by the flange. There may be a transparency placed between the cap and the cover part which provides printed words and/or graphics, which may be specific to the machine.

Preferably the switch actuating structure has a generally square frame with a square bottom wall provided with a centrally disposed aperture. Two elongate legs with outwardly turned feet may be provided projecting from the centre of opposed bottom wall edges at right angles to the edges. Preferably also, the bottom wall has spring members fixed across the frame to provide the relative movement of the button within the flange structure. Two of the opposed spring members preferably have push rods mounted in a downwardly projecting direction, which project through apertures in the bottom wall so as to be displaceable within the button.

Preferably the switch comprises a rectangular body with an upwardly projecting actuator and connector terminals. The body most preferably overlies the inner side wall structures within the confines of the housing with the terminals projecting out of the housing. Most preferably the switch is a microswitch.

Preferably, the lamp is disposed in the centre of the housing and may be mounted on a rectangular strip with connector terminals. The lamp may be a filament lamp but is most preferably an LED or a plurality of LEDs. The strip preferably overlies the switch within the confines of the housing with the terminals projecting out of the confines of the housing. The lamp may emit white or coloured light when energised with varying intensities.

Alternatively, the lamp may also provide an image producing component such as an LCD panel, where the crystals in the LCD panel can be energised by supplying a current thereto making the individual crystals twist to allow light from the lamp through to illuminate the button with an image. Such a panel may be mounted between said lamp and said button. This will control light emitted from the lamp. Colour filters may be applied to allow different colours and effects.

Alternatively still, the lamp may comprise an OLED which provides the lighting and an image producing component (Organic Light Emitting Device) wherein a series of organic layers, for example small-molecular weight or polymer-based organic materials, between two electrical contacts are applied to a carrier such as glass or plastics film. The carrier may be flexible. The OLED may be instead of, or in addition to the lamp.

Preferably, the lamp strip and the switch body are separate components. Alternatively, they may be a single unit. Preferably the lamp and the switch are removably mounted within the housing and most preferably the strip and the body of the lamp and the switch respectively completely within the confines of the housing. The switch body and lamp strip may snap onto a part of the housing and may be held in place by pegs which pass first through the body of the switch and then through the strip of the lamp. Alternatively, screws could be used in place of the pegs, or the unit could be glued into position.

The terminals from the lamp and the switch may be connected to appropriate operating circuitry of an amusement or gaming machine. The LCD panel or OLED may also be connected to the operating circuitry of an amusement or gaming machine. The lamp can be activated in different ways on different occasions which may correspond to stages in the game.

When fixed to an amusement or gaming machine the push button assembly may be mounted on a panel of the machine, which may be a glass or plastics or metal or other panel, by insertion of the housing frame through the aperture in the panel, the aforesaid spring clip or clips springing outwards into position on the underside of the panel, resulting in the flange and the push button being on the exterior of the panel, the lamp and the switch being below the panel, within the confines of the housing, except for the terminals which project downwardly for connection to the appropriate circuitry.

BRIEF DESCRIPTION OF THE DRAWINGS

The invention will now be described further by way of example only and with reference to the accompanying drawings in which.

MODES FOR CARRYING OUT THE INVENTION

Figure 3:
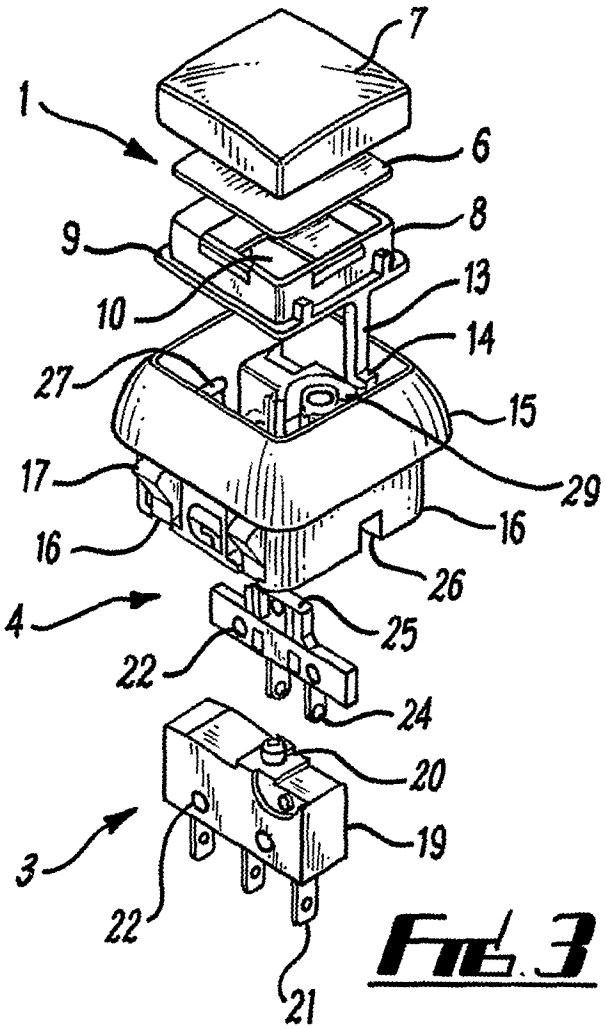
FIG. 3 is an exploded upright perspective view of the push button assembly.

As shown in FIG. 3 a push button assembly has a push button 1, a housing 2, a switch unit 3, and an illumination unit 4.

The push button 1 comprises a switch actuating structure 5, a translucent cover part 6 and a square translucent cap 7 having an upwardly slightly convexly domed square top wall bounded by peripheral downwardly projecting edge walls.

The switch actuating structure 5 comprises a square frame 8 bounding an attached square bottom wall 9 with a central aperture 10. A push rod 12 projects downwardly from the bottom wall 9 at right angles thereto in the region between the central aperture 10 and the centre part of opposite edges of the bottom wall 9. A spring (not shown) sits around the push rod 12 which then sits within a cylinder 29 provided by the housing so the push rod is displaceable therewithin. A further rod (not shown) is provided on the opposing side of the bottom wall 9, which is positioned above the switch unit 3. Centrally of two of the bottom wall edges at right angles to the aforesaid edges there are two elongate legs 13 which project downwardly from the wall at right angles thereto and terminate at their free ends in outwardly turned feet 14.

The housing 2 comprises a generally square frame 18 structure having at one end an opaque peripheral flange 15 with outwardly inclined side walls tapering towards the top free end of the frame structure and peripheral side wall structures 16 depending from the underside of the peripheral flange 15. Two opposed side wall structures 16 are provided on their outer side with respective pairs of spring clips 17. One such side wall structure has fixing holes therethrough. The flange 15 comprises a composite carbon material which has high resistance conductive properties.

The flange structure 15 may also comprise a downwardly projecting peripheral light-transmitting skirt part (not shown) which defines a peripheral gap between said skirt part and the side wall structures 16, so as to provide an illuminable boundary. The boundary may be illuminable by a generally square printed circuit board carrying multiple LEDs around its periphery, which comprises a central aperture through which the side wall structures 16 pass, the LEDs thereby being positioned in said gap and covered by the skirt part. The LEDs are connected to appropriate circuitry on the board for operation independently of one another and the lamp 25.

The housing 2 also comprises "grounding members" 15*a* which comprise for example carbon conductive structures with high resistance leading from the flange 15 through the illuminable skirt part and which make contact with a panel of a gaming or amusement machine. Where the panel is made of an insulating material e.g. glass or plastics, the panel has printed regions of conductive material. Where the panel is constructed of a conductive material e.g. metal such regions are not required. In both cases, the panel is earthed or grounded by a highly resistant conductive housing of the machine or other suitable earthing component, so that any electrostatic charge can be carried away from the circuitry of the assembly. This arrangement is to prevent spurious activation of the button 1 where an electrostatic charge is applied in fraudulent activities. Where the flange structure has a skirt part, these can be provided in the skirt part which contacts the panel.

The interior of the housing between the side wall structures 16 is generally open and the illumination unit 4 and the switch unit 3 are mounted within the housing 2.

The frame structure is of short axial length and in particular is shorter than the horizontal length of each side wall structure 16.

Figure 1:
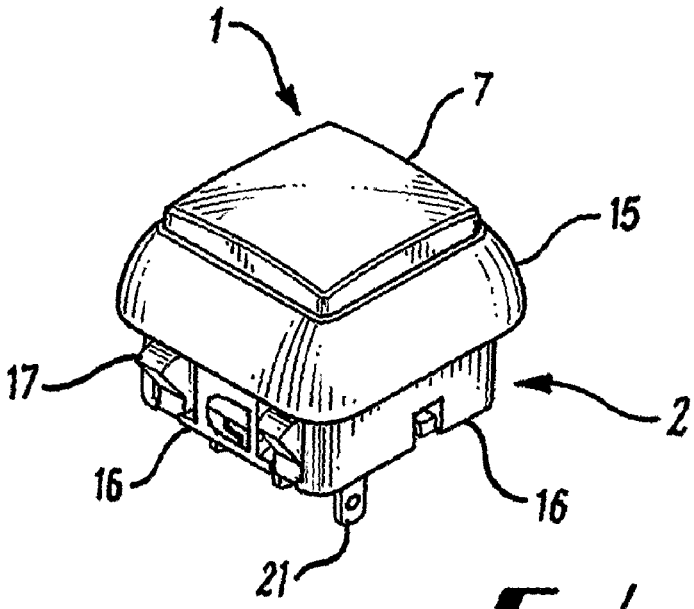
FIG. 1 is a perspective view of one form of an assembled push button assembly in accordance with the invention.
Figure 2:
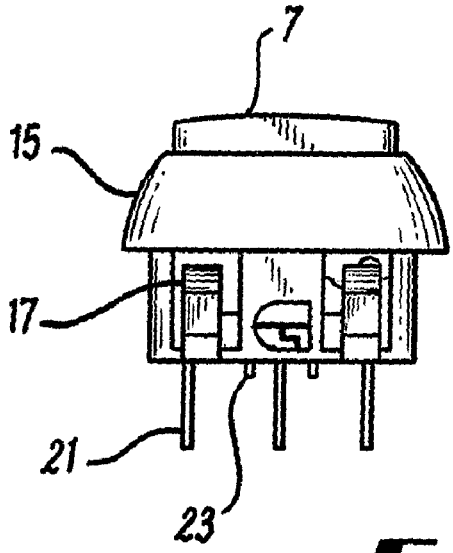
FIG. 2 is a diagrammatic side view of the assembly of FIG. 1.
Figure 4:
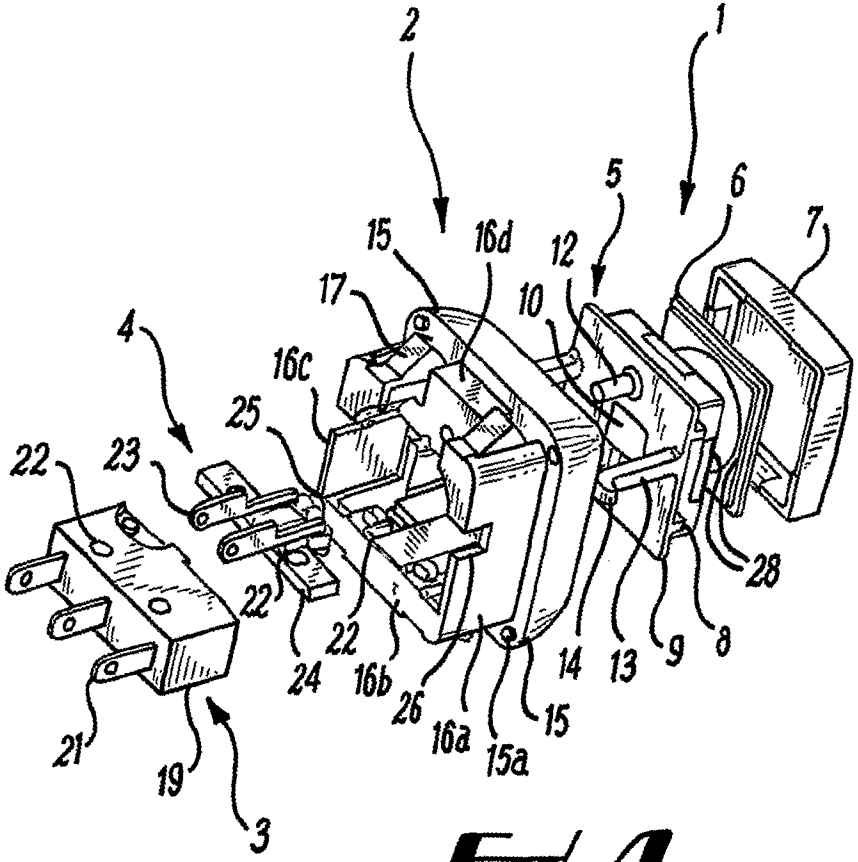
FIG. 4 is an exploded side perspective view of the push button assembly.

The switch unit 3 is a conventional microswitch having a rectangular body 19 with an actuator projection 20 projecting upwardly from a narrow top side body and three connector terminals 21 projecting downwardly from the opposite narrow bottom side of the body 19. The body is located within the housing 2 and overlies the inner side of the side wall structure 16*b*. The body 19 is contained wholly within the confines of the housing 2 and the terminals 21 project downwardly out of the housing as shown in FIG. 2. The switch unit 3 is held in position by the body snapping onto a part of the moulding and pegs passing through aligned holes 22 in the side wall structure and the body 19 of the switch unit 3. Alternatively screws or other means may be used to fix the switch body in position.

The illumination unit 4 comprises a lamp which is an LED 25 fixed to connection terminals 23 mounted on a supporting strip 24. The strip 24 and LED 25 are fixed within the housing 2 so as to be wholly within the confines of the housing. The strip 24 overlies the body of the switch unit 3 and is held in position by the aforesaid pegs which also pass through holes 22 in the strip 24. The terminals 23 project downwardly out of the housing parallel to the switch unit terminals 21. The illumination unit 4 is fixed in position with the LED 25 disposed centrally of the housing. Alternatively a plurality of LEDs which might not be centrally disposed may be used.

Additionally, an LCD panel (not shown) may be introduced between the lamp 25 and the button 1, where an electrical charge applied to the crystals can cause rotation of the crystals to allow light through to illuminate the button 1 from the lamp 25. Colour filters can be applied to each crystal to generate different colours of light which is dependent upon the degree of rotation of the crystals and the wavelength of light passing therethrough. The LCD panel is an image producing component.

Alternatively to said lamp 25, OLEDs may be used (Organic Light Emitting Device) which provides the lighting and an image producing component. The OLED comprises a film having a series of organic polymers and or low molecular weight organic compounds which are light emitting, positioned between two electrodes which is applied to a carrier substrate such as glass or flexible plastics material. The electrodes can be connected to the circuitry of the amusement or gaming machine for control. The film can be inserted between the button 1 and the housing 2.

The push button 1 is assembled with the housing by insertion of the frame 8 downwardly into the housing through the peripheral flange 15 so that the legs 13 slide along the inner sides of the two opposed side wall structures 16*a*, 16*c* of the frame structure. The legs 13 are springy and deflected slightly inwardly until the legs reach recesses 26 at the bottom edges of the side wall structure. The feet 14 spring back into these recesses 26 to lock the frame structure in a position at which the frame is wholly within the confines of the housing. In this position the central aperture 10 fits around the lamp 25 and one of the push rods 12 is aligned with the microswitch actuation projection 20.

The cover part 6 sits on the frame 8 and the cap 7 sits on top of the cover part around the frame 8 and projects partially beyond the open top end of the peripheral flange 15. The cap 7 is retained within the flange 15 by interengagement with the frame 8 but is free to move through a limited distance into and out of the flange 15 being limited by abutments 27 in the housing. The cover part 6 has a projecting part 28 on its lower surface.

With this arrangement, a natural "halo" effect occurs when the lamp 25 or other button 1 lighting device, such as an OLED, is illuminated where light is emitted in a defined line between the flange structure 15 and the cap 7 of the button 1. As appreciated this may be in addition to any boundary illumination halo effect as previously discussed.

The cap 7 can be pushed in with the push rod 12 pressing against the resistance of the spring to cause the opposing rod to move downwardly to actuate the microswitch 20.

The push button assembly can be mounted on a panel by insertion of the frame structure 18 of the housing through a hole in the panel to a position at which the peripheral flange 15 abuts inside the panel around the hole, the "grounding members" 15*a* thereby making contact with the panel.

The push button is held in position by the four spring clips 17 springing outwardly into position on the underside of the panel.

The cap 7 projects freely from the panel for manual operation and the peripheral flange 15 provides a bezel around the cap 7.

On the underside of the panel the terminals 21, 23 project freely for connection to appropriate circuitry. Other parts of the assembly do not take up much space beneath the panel and it will be noted that the assembly can be fixed securely in position without requiring application of any fixing structure, or manipulation of the assembly beneath the panel.

The panel may be a screen-printed panel of a fruit machine or other amusement or gaming machine whereby the lamp terminals 23 can be connected to the usual operating circuitry so that the lamp 25 is switched on with a steady or flashing light at appropriate occasions to signify that the button assembly can be used to initiate a game play procedure or event or for other purposes; and the switch terminals 21 can be connected to the usual operating circuitry to cause activating impulse to be fed thereto by operation of the push button when appropriate.

Furthermore, the independently operable boundary illumination, producing a halo effect around the flange structure 15, can also produce various lighting arrangements alone or in combination with the lamp 25. For example, the boundary may be wholly or partially lit, and/or be made to flash and/or the individual LEDs may be lit to produce points of light around the boundary. Alone, the steady or flashing boundary illumination may indicate a specific mode of play or may indicate an inoperable machine in a so called "attract" mode.

It is of course to be understood that the invention is not intended to be restricted to the details of the above embodiments, which is described by way of example only. Thus, the boundary illumination may be effected by other suitable lighting arrangements such as the previously described OLEDs or LCD arrangements. Furthermore, alternatives to the lamp and LCD panel/OLED arrangements may include any other suitable LCD or LED technology such as cholesteric LCD's, Zenithal bistability LCD's, twisted nematic LCD's (bistable and super varieties), thin film transistors, and polymer LED's to generate the illumination and/or an image producing component.

The invention claimed is:

1. A pushbutton assembly comprising a housing with an open end thereto bounded by a flange structure, the housing being insertable through an aperture in a panel with the flange on an outer side thereof, a fixing means for fixing the housing relative to the panel beneath the panel, a push button movably mounted within the open end and flange structure, a lamp mountable relative to the housing for illuminating the button, a switch mountable relative to the housing for operation by movement of the button via an actuating structure disposed between the button and the switch within the housing, characterized in that the lamp and the switch are mounted within the housing so that at least a major part of the lamp and the switch is located within the confines of the housing and wherein the switch is a microswitch comprising a rectangular body with an upwardly projecting actuator and connection terminals and the rectangular body overlies the inner side wall structures within the confines of the housing and the connection terminals project out of said housing.

2. The push button assembly according to claim 1 wherein the housing has a generally open square frame structure comprising side wall structures with the flange structure mounted at one end.

3. The push button assembly according to claim 2 wherein at least one of the side wall structures is generally open to provide access to the interior of the housing.

4. The push button assembly according to claim 2 wherein the frame structure is shorter in axial length than the horizontal length of each of the side wall structures.

5. The push button assembly according to claim 2 wherein the flange structure is opaque.

6. The push button assembly according to claim 1 wherein the housing provides abutments for supporting the actuating structure.

7. The push button assembly according to claim 1 wherein the flange structure has outwardly inclined side walls which taper towards the top free end of the housing.

8. The push button assembly according to claim 1 wherein the flange structure is opaque.

9. The push button assembly according to claim 1 wherein the housing provides electrostatic protection to any circuitry within said housing And wherein the protection comprises "grounding members" integrated into said housing to discharge any introduced electrical charges.

10. The push button assembly according to claim 1 wherein the fixing means comprises one or more clips on one or more of said side wall structures engageable with holes in said panel.

11. The push button assembly according to claim 1 wherein the switch actuating structure comprises a generally square frame with a centrally disposed aperture and two elongate legs with outwardly turned feet projecting from the center of opposed bottom wall edges at right angles thereto.

12. The push button assembly according to claim 1 wherein the lamp is disposed in the center of the housing mounted on a rectangular strip with connector terminals.

13. The push button assembly according to claim 12 herein the lamp strip and switch body are separate components.

14. The push button assembly according to claim 13 herein the strip and the body are completely within the confines of the housing.

15. The push button assembly according to claim 12 wherein each one of the body and strip snaps onto a part of the housing and is held in place by pegs passing through the body of the strip.

16. The push button assembly according to claim 1 wherein the lamp is an LED or multiple LEDs.

* * * * *